US007281277B1

(12) United States Patent
Uchida

(10) Patent No.: US 7,281,277 B1
(45) Date of Patent: Oct. 16, 2007

(54) FOOT OPERATED TOILET SEAT LIFTER

(76) Inventor: Toshi K. Uchida, 30970 Via La Cresta, Rancho Palos Verdes, CA (US) 90275

( * ) Notice: Subject to any disclaimer, the term of this patent is extended or adjusted under 35 U.S.C. 154(b) by 111 days.

(21) Appl. No.: 10/465,509

(22) Filed: Jun. 18, 2003

(51) Int. Cl.
*A47K 13/10* (2006.01)

(52) U.S. Cl. ..... 4/246.1

(58) Field of Classification Search ..... 4/246.1–246.4; 220/262–263
See application file for complete search history.

(56) References Cited

U.S. PATENT DOCUMENTS 2,088,050 A * 7/1937 Brown ..... 4/246.4
2,136,684 A * 11/1938 Greavu ..... 4/246.5
2,632,896 A * 3/1953 Morikawa ..... 4/246.1
4,150,446 A * 4/1979 Crocker ..... 4/246.3
4,534,073 A * 8/1985 Smith ..... 4/246.4
4,584,724 A * 4/1986 Wilson ..... 4/246.5
5,487,192 A * 1/1996 Hodges ..... 4/246.3
5,829,067 A * 11/1998 Smith ..... 4/246.1
6,112,336 A * 9/2000 Markle et al. ..... 4/246.1

FOREIGN PATENT DOCUMENTS

DK 0067372 * 8/1948

* cited by examiner

*Primary Examiner*—Charles E. Phillips
(74) *Attorney, Agent, or Firm*—Natan Epstein

(57) ABSTRACT

A pedal actuated seat lifter has a mounting plate fastened between a toilet bowl and its seat using existing bolts holding the seat in place. A floor pedal transmits lifting force through a chain or the like to a lever and lifting arm hinged to the mounting plate. The seat lifter can be provided as a kit of parts for relatively simple assembly and installation on an existing toilet fixture without use of adhesives or alteration of the toilet fixture, the floor or walls.

14 Claims, 4 Drawing Sheets

FOOT OPERATED TOILET SEAT LIFTER

BACKGROUND OF THE INVENTION

1. Field of the Invention

This invention relates generally to foot operated devices, mechanisms and aids for lifting the hinged lid and seat of a sanitary toilet fixture.

2. State of the Prior Art

Sanitary toilet fixtures typically consist of a floor mounted ceramic bowl with an drain connected to a sewer outlet and a system for flushing the bowl with water following use. A seat, typically of wood or plastic, is normally supported on the rim of the ceramic bowl for the comfort of a seated user. The toilet seat is hinged to the rear of the bowl to permit the front of the seat to be lifted out of the way, in order to prevent unsanitary splashing and soiling of the seat when the toilet bowl is used by a standing male. While it is desirable to lift the seat in order to preserve the sanitary condition of the seat for subsequent users of the toilet facility, many persons are reluctant to touch the seat with their hands in order to do so, with the result that the seat is left in a lowered condition and becomes soiled. Conversely, it often happens that in a shared bathroom one user habitually tends to leave the toilet seat up, to the continuing frustration of other users who must lower the seat before using the toilet.

This problem has been long recognized and many attempts have been made towards a solution. Many of these prior devices feature a pedal connected for raising the toilet seat when the pedal is depressed by a person standing in front of the bowl. While most of the previously known mechanisms are effective in relieving the user from hand contact with the seat, they have not been widely adopted because of their complexity or difficulty of installation. Some of these devices must be bolted to the floor next to the toilet bowl while others call for specially designed toilet bowls or toilet seats. Still others involve cumbersome and visually unappealing constructions or may be awkward to use.

In spite of the many prior attempts at addressing this problem, no satisfactory solution has yet been found, and a continuing need exists for a simple, low cost and unobtrusive foot actuated toilet seat lifting device which can be easily installed in most existing or new toilet bowl installations without modification to either the toilet bowl or the seat.

SUMMARY OF THE INVENTION

This invention addresses the aforementioned need by providing a foot actuated toilet seat lift for a toilet fixture having a bowl and a seat hinged to a pair of mounting bolts secured in mounting holes in the bowl. The novel lift mechanism has a pedal assembly including a floor base and a pedal hinged to the floor base for movement between a normal elevated condition and a depressed condition, and an actuator assembly including a seat base adapted for mounting to the bowl solely by the mounting bolts. The actuator assembly includes a lifter element movably supported on the base and operatively connected to the pedal assembly for lifting the seat responsive to depression of the pedal from said normal elevated condition.

More specifically, the actuator assembly includes an actuating lever and a lifting arm both supported to the seat base on a hinge. The seat base is adapted to receive the mounting bolts such that the actuator assembly may be secured between the seat and the bowl by sole means of the mounting bolts, with a free end of the lifting arm positioned under the seat. The hinge axis is preferably aligned so that an axis line passes through both of the mounting bolts. The operative connection between the lift arm and the pedal is by a linkage, such as a chain, string, cable or the like. The pedal preferably includes an extension rod which has a free end connected to the linkage and acts as a lever to amplify the movement of the pedal. Depression of the pedal on a floor surface adjacent to the bowl is transmitted by the linkage for depressing the actuating lever to rotate or turn the hinge and thus raise the free end of the lifting arm, which in turn lifts the seat away from the bowl. The lift arm returns to a lowered position under the weight of the seat for lowering said seat upon release of said pedal from a depressed position to a normal position.

The seat base is generally planar, preferably a thin, elongated plate, perforated with holes for passing the mounting bolts of the toilet seat, for relatively unobtrusive mounting between the seat and the bowl. The actuating lever and the lifting arm are both mounted to a common pivot hingedly connected to the seat base. The pivot may include a shaft extending from the seat base so as to support the actuating lever and the arm at a sufficient distance to one side of the bowl for the pedal and the actuating lever to be conveniently positioned to one side of the toilet fixture. The lift arm and the actuating lever preferably extend in generally opposite directions from the shaft, such that the lift arm extends generally forwardly from the base and the actuating lever extends generally rearwardly from the seat base in an installed operative condition of the actuator assembly. For convenience the linkage, such as a length of chain, is preferably adjustable in length between the rod and the actuating lever.

These and other features, improvements and advantages of the foot actuated toilet seat lifter of this invention will be better understood by reference to the following detailed description taken in conjunction with the accompanying drawings.

DETAILED DESCRIPTION OF THE PREFERRED EMBODIMENT

Figure 1:
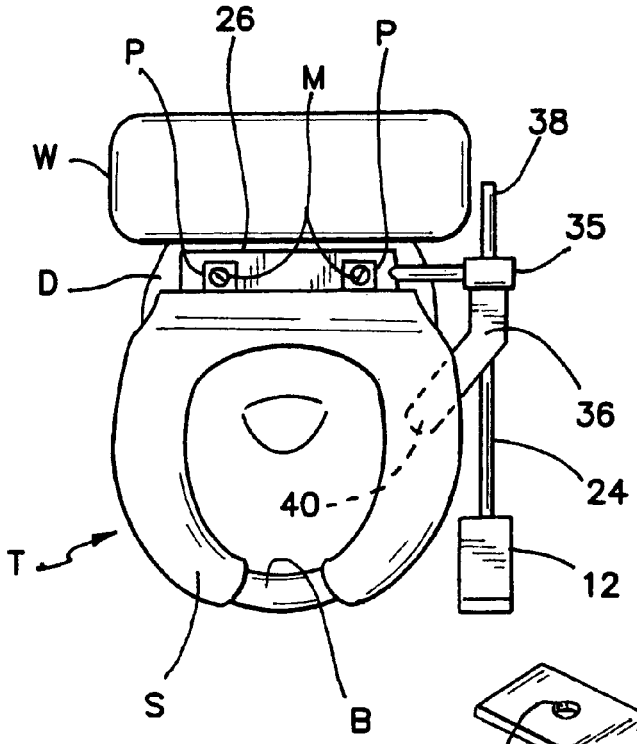
FIG. 1 is a top plan view of a typical sanitary toilet fixture equipped with the foot actuated toilet seat lifter of this invention.
Figure 5:
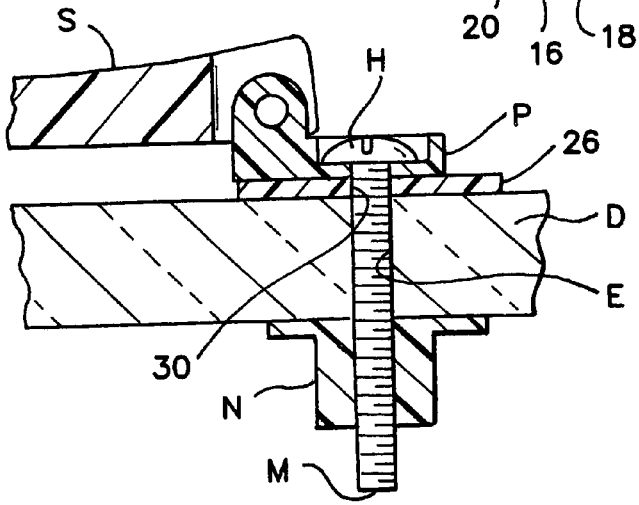
FIG. 5 is a detail view taken in elevational cross section showing how the seat base of the lifter mechanism is installed between the toilet seat and the toilet bowl by means of the toilet seat bolts.

With reference to the drawings wherein like elements are designated by like numerals, FIG. 1 shows a toilet bowl fixture generally designated by the letter T. The fixture T includes a toilet bowl B with a rear deck D and a water tank W. A toilet seat S is secured to the top of the bowl B by means of two mounting bolts M. The seat has two mounting plates P hinged to the seat S. The bolts M each pass through aligned holes in a corresponding one of the mounting plates P and in the rear deck D of the toilet bowl B. Each mounting bolt M has a bolt head H above the plate P and a threaded shaft which passes through the aligned openings and engages a retaining nut N underneath the rear deck D, as best seen in FIG. 5. The nut N is tightened against the underside of deck D to secure the mounting plate P in place against the top side of the deck D.

Figure 2:
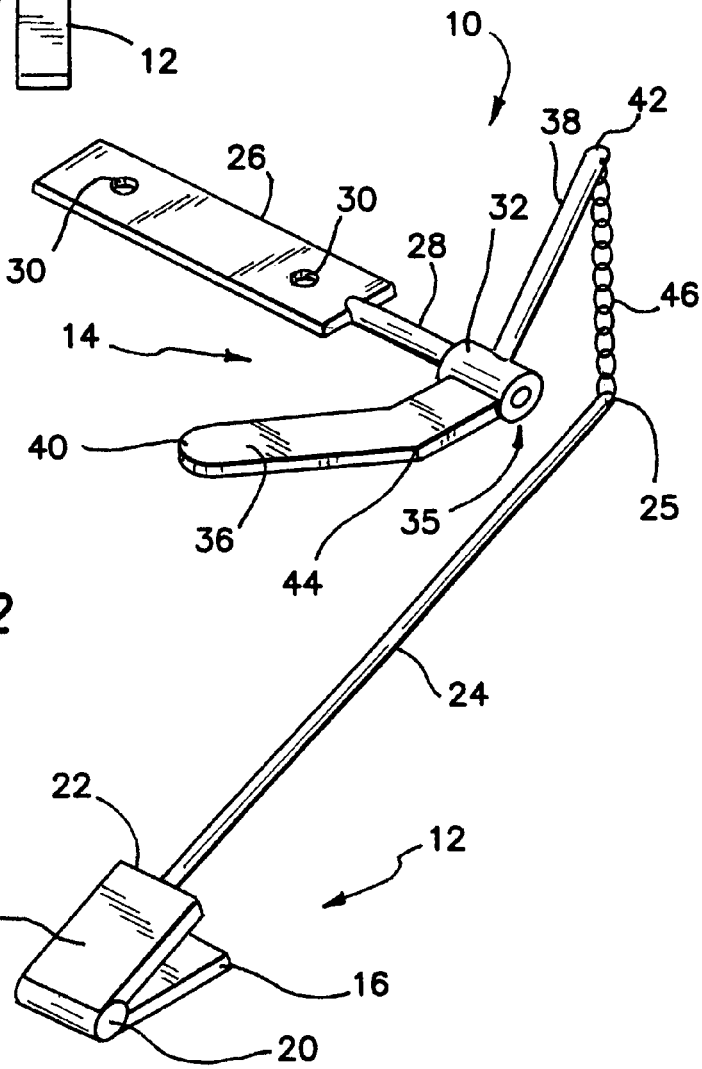
FIG. 2 is a perspective view of the foot actuated toilet seat lifter of FIG. 1.

Turning now to FIG. 2 of the drawings, the foot operated toilet seat lifter mechanism is generally designated by the numeral 10, and includes a floor mounted pedal assembly 12 and an actuator assembly 14 which is mounted to the toilet fixture T in a manner which will be described below. The pedal assembly 12 includes a floor base 16 and a pedal 18 connected to the floor base by a hinge 20 along a rear edge of the pedal. An extension rod 24 extends from the free edge 22 of pedal 18 and terminates in a free end 25.

The actuator assembly 14 includes a generally planar seat base 26 from which extends a shaft 28. The seat base 26 is relatively thin, flat and elongated, and may be of generally rectangular shape. The thickness of the seat base 26 is sufficiently thin so that insertion of the seat base between the toilet bowl deck D and the toilet seat S does not raise the rear of the seat to an objectionable degree. A sufficiently rigid and strong, yet thin base plate 26 can be made of sheet metal or plastic of, for example and without limitation, $1/8^{th}$ inch thickness. The specific configuration of the base plate is not critical and may be adapted to the particular material used, as well as to particular toilet fixture configurations. The base plate 26 may also have thin portions between the seat and bowl and thicker reinforced portions which are not between the seat and the bowl so as to minimize elevation of the seat. The length of the seat base 26 exceeds the spacing between the two mounting bolts M, and is perforated by two bolt holes 30 located in the seat base for passing the two mounting bolts. A rotor sleeve 32 turns on shaft 28 and, together with the shaft, makes a hinge 35. The rotor sleeve 32 supports a lift arm 36 and an actuating lever 38 for rotation relative to the seat base, with the arm 36 and the lever 38 extending generally in diametrically opposite directions on the rotor sleeve. The lift arm 36 and the actuating lever 38 each have a free end, 40 and 42 respectively. The lift arm is bent at an elbow 44 such that its free end 40 lies under the seat S in an installed condition of the actuator assembly 14, as best appreciated in FIG. 1 where the portion of the lift arm underlying the seat is suggested in phantom lining.

The mechanism 10 is installed on the toilet fixture T by first freeing the existing mounting bolts M which hold the seat S to the bowl B, and lifting the mounting plates P away from the toilet bowl deck D to fully withdraw the bolts M from their respective bolt holes in the bowl. The seat base 26 is then placed on the rear deck D of the seat bowl and the bolt holes 30 of the base 26 are aligned with the existing bolt holes E in the toilet bowl. The seat S is then replaced on the bowl B, and the mounting plates P are positioned on the seat base 26 such that bolts B can be inserted through the plates P and the seat base and into the corresponding bolt holes in the rear deck D of the toilet bowl, as best understood by reference to FIG. 5. Installation of the actuating assembly is completed by threading and tightening a nut N onto each bolt M to hold the plate P firmly against the deck D, thereby securely capturing the base 26 between the plates P of the toilet seat S and the deck D of the toilet bowl B. The end 40 of the lift arm is lowered onto the top rim R of the toilet bowl B and when the seat S is installed and lowered the lift arm is captive between the bowl B and the seat S. In most toilet fixtures the seat S is supported in spaced relationship to the rim R of the bowl by spacers C affixed either to the rim or to the underside of the seat near the front of the seat, so that there is a small gap between the seat and the bowl rim R, as may be observed in FIG. 3. The thickness of the lift arm 36 is somewhat smaller than this gap so that the seat S preferably rests on the existing spacers C and not on the lift arm.

Figure 3:
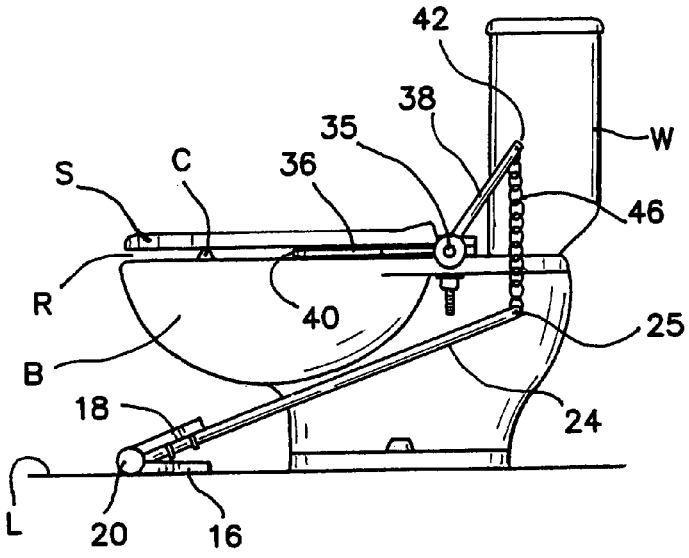
FIG. 3 is a side elevational view of the toilet fixture and seat lifter installation of FIG. 1, showing the seat lifter mechanism in a normal condition corresponding to a lowered position of the toilet seat.
Figure 4:
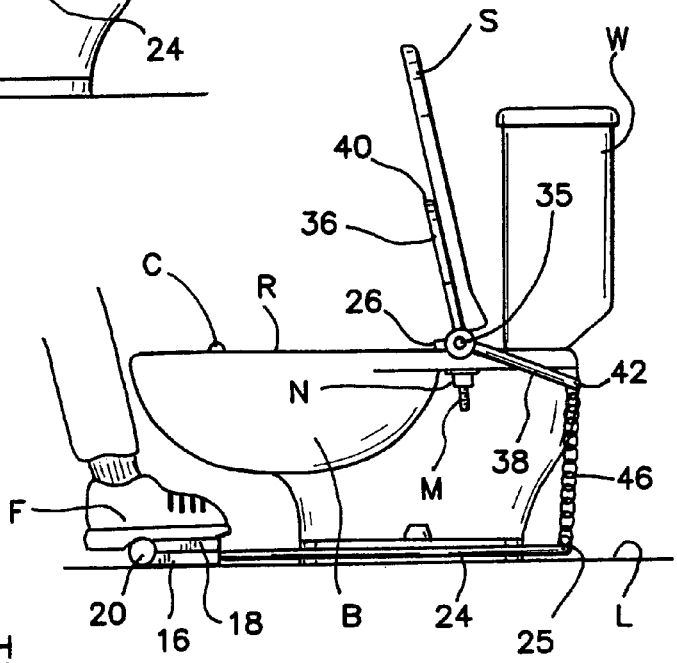
FIG. 4 is a side elevational view as in FIG. 3 but showing the pedal of the lifter mechanism in a depressed condition under a user's foot for holding the seat in a raised position away from the toilet bowl.

The pedal assembly 12 does not require any particular installation other than placing the pedal assembly on the floor L to one side of the toilet bowl B such that the free end 25 of the rod 24 is generally under the free end 42 of the actuating lever 38. Finally, a link chain 46 is attached at one end to free end 25 of the rod 24 and at another end to the free end 42 of the actuating lever 38 to operatively connect the lift arm 36 to the pedal assembly 12. The weight of the lowered toilet seat S bearing on the free end 40 normally holds down the lift arm 36 against the rim R of the toilet bowl, as in FIGS. 1 and 3. The actuating lever 38 is mounted to rotor sleeve 32 at an obtuse angle relative to the lift arm 36, so that in a normal, fully depressed condition of the lift arm 36 the actuating lever 38 extends upwardly at about a 45 degree angle to the horizontal and at about a 135 degree angle away from the lift arm 36 on the rotor sleeve, as shown in FIG. 3. It should be understood that the various angles just given are not critical and may vary so long as an operative relationship is maintained between the various elements of the lifter mechanism 10. The length of the link chain 46 is such that the free end 42 of the elevated actuating lever 38 pulls on the link chain 46 and normally holds the pedal 18 in an elevated condition away from the floor base 16, as also shown in FIG. 3. The pedal assembly 12 may be positioned at a location on the floor L to suit the user's convenience relative to the toilet bowl. The effective length of the link chain 46 can be made adjustable by engaging the chain to either free end 25 or 42 at any intermediate point of the chain, thereby shortening the effective length of the link to a variable degree, in order to achieve an appropriate normal elevation of the pedal 18 for a given location of the pedal assembly 12. When the pedal 18 is depressed, the extension rod 24 swings down through an arc and the free end 25 of the rod drops towards the floor L, thereby pulling down on free end 42 of actuating lever 38 through the link chain 46. The extension rod 24 amplifies the arc of movement described by depression of the pedal so that a relatively small movement of the user's foot F produces a sufficient response of the actuating assembly 14. The downward force on the end 42 of lever 38 translates into a torque acting on rotor sleeve 32 and a consequent upward swing of the lift arm 36, the free end 40 of which then pushes up under the seat S lifting the seat away from the bowl B, to an elevated condition depicted in FIG. 4. The normal elevation of the pedal 18 should be such that, when the pedal is fully depressed by the foot of a user, the seat S is lifted sufficiently to permit convenient access to the interior of the toilet bowl by the user. It is important, however, that the maximum elevation of the seat S be to an angle of less than 90 degrees, as shown in FIG. 4, so that at maximum elevation some of the weight of the seat still bears down on the lift arm 36 to maintain tension on the link chain 46 through the actuating lever 38. That is, the seat S remains elevated only so long as the user's foot restrains the pedal against the upward force acting through link chain 46. When finished, the user simply lifts his foot from the pedal 18 to allow the seat S to return to the lowered position of FIG. 3 and the pedal to its normal elevated condition. As a result, the seat S always returns to a lowered condition, and can be temporarily lifted without objectionable touching.

It will be appreciated from the foregoing description that the seat lifter mechanism 10 is quickly and easily installed in most conventional toilet fixtures without modification to either the toilet bowl or the toilet seat. The installation does not require any special tools or skills, and is readily reversible without damage to the toilet fixture so that, for example, the lifter 10 can be taken and reinstalled by someone moving to another residence. The pedal assembly may be easily moved and repositioned to suit the convenience of each user and to fit the particular toilet installation. It can also be easily moved out of the way when cleaning the bathroom, and if desired can itself be taken and washed at a location away from the toilet simply by temporarily disconnecting the link chain 46. The actuating assembly 14 is of simple construction and its surfaces are generally accessible for cleaning. The lifter 10 can be made of any materials, such as metals or plastics, of sufficient strength and rigidity to withstand the modest forces required for its operation.

Turning now to FIGS. 6 through 9, two alternate forms of the invention are illustrated which differ from the embodiment of FIGS. 1 through 5 as will be now described.

Figure 6:
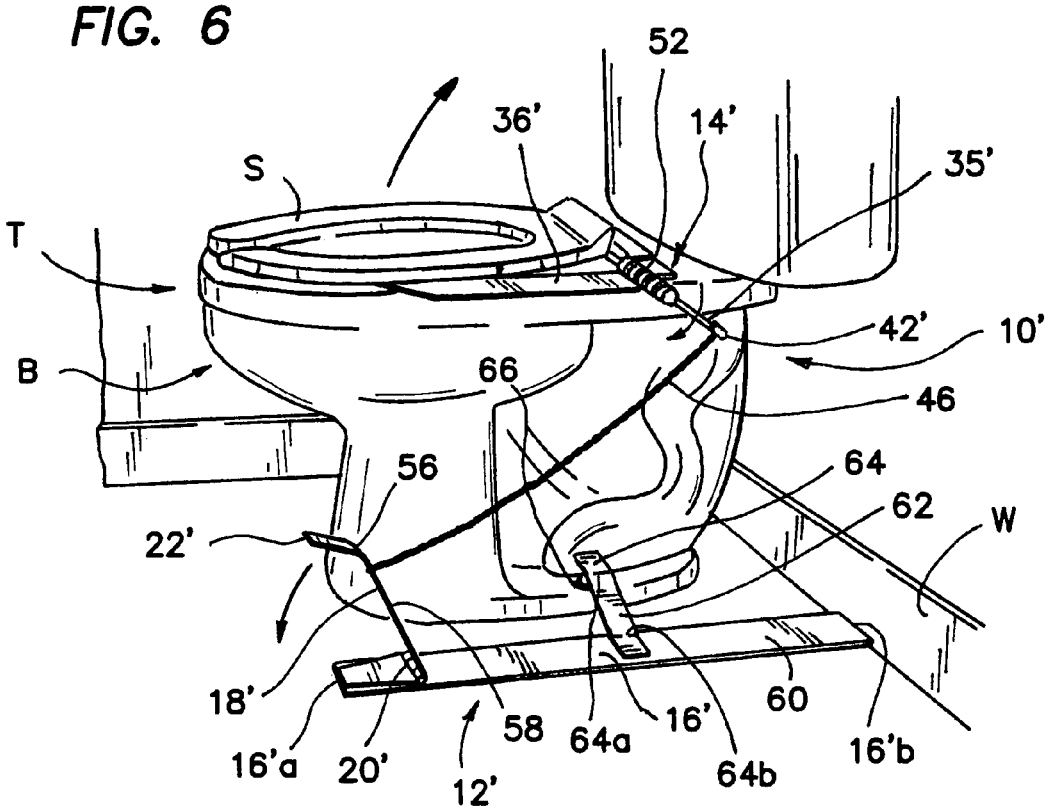
FIG. 6 is a perspective view of a first alternate embodiment of the foot actuated toilet seat lifter of this invention.
Figure 7:
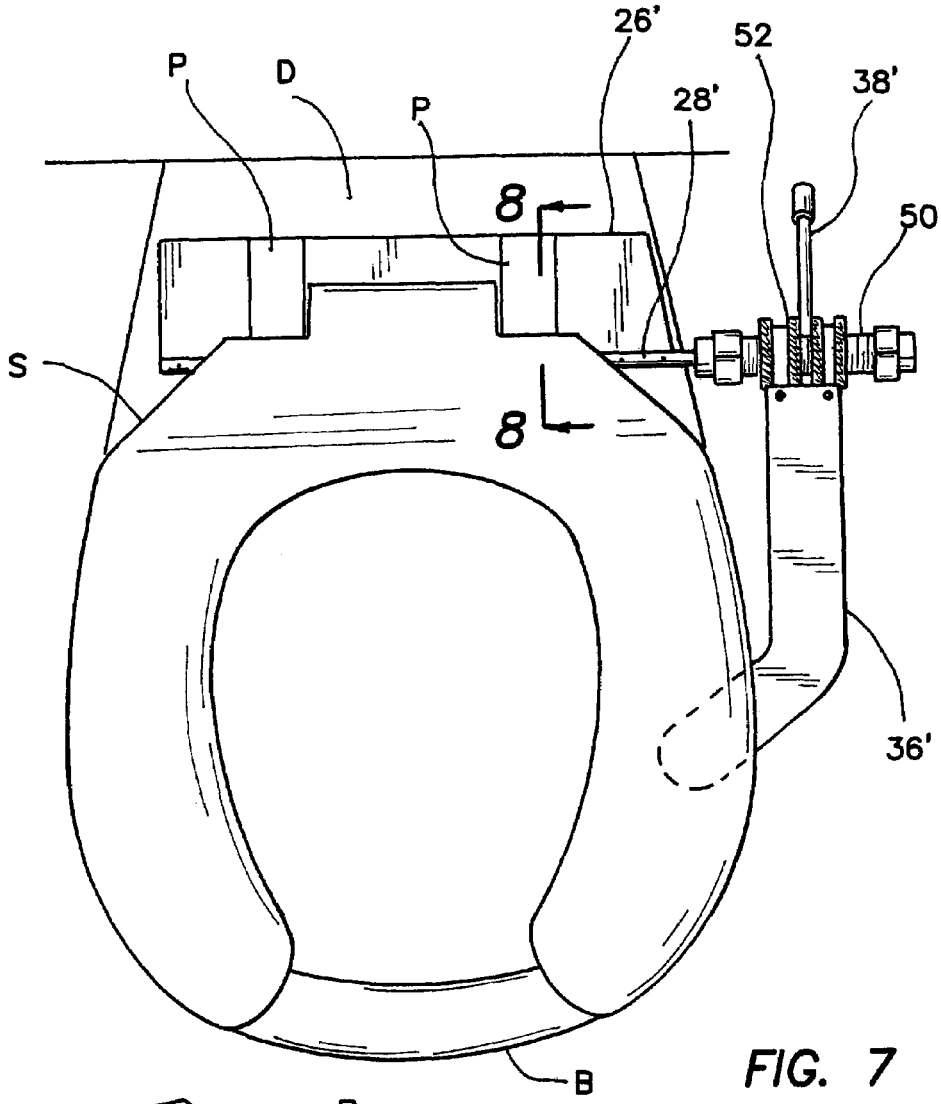
FIG. 7 is a top plan view of the seat lifter actuator assembly installed in a toilet bowl fixture.

In FIG. 6 a foot actuated toilet seat lift generally designated by numeral 10' includes a modified floor mounted pedal assembly 12' and an actuator assembly 14', better seen in FIG. 7. Pedal assembly has a floor base 16' and a pedal 18' connected to the floor base by a hinge 20' along a rear edge of the pedal 18'.

Figure 8:
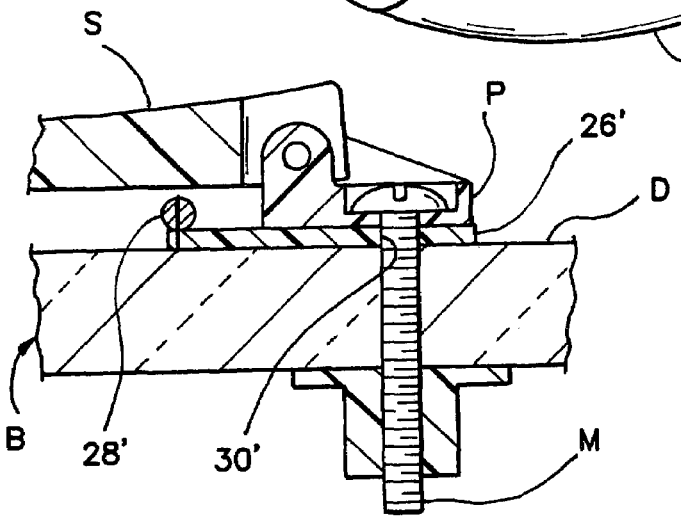
FIG. 8 is an elevational cross sectional view taken along line 8-8 in FIG. 7 to show the mounting of the seat base to the toilet bowl fixture.

The actuator assembly 14' includes a generally thin, planar seat base 26' along which is fastened a relatively strong and rigid shaft 28'. The shaft 28' preferably extends the length of the seat base 26' and also extends some distance to one side of the toilet bowl B. The shaft 28' may be a metallic rod for greater strength, suitably attached along its length to the base 26'. The seat base 26' is secured to the bowl B in a similar manner to that described for base 26 in FIGS. 3 through 5, by passing the mounting bolts M through corresponding bolt holes 30' in the base 26'. A threaded sleeve 50 of enlarged diameter is fixed onto the laterally projecting end of shaft 28'. A lift arm 36' and an actuating lever 38' are fixed to each other and rotatably supported on sleeve 50 by means of a rotor sleeve assembly 52. Installation of the actuator 14' is similar to the installation described earlier in connection with actuator 14 of FIG. 2. FIGS. 7 and 8 show the actuator installed on the toilet bowl deck D, between the mounting plates P of toilet seat S and deck D of bowl B.

Figure 9:
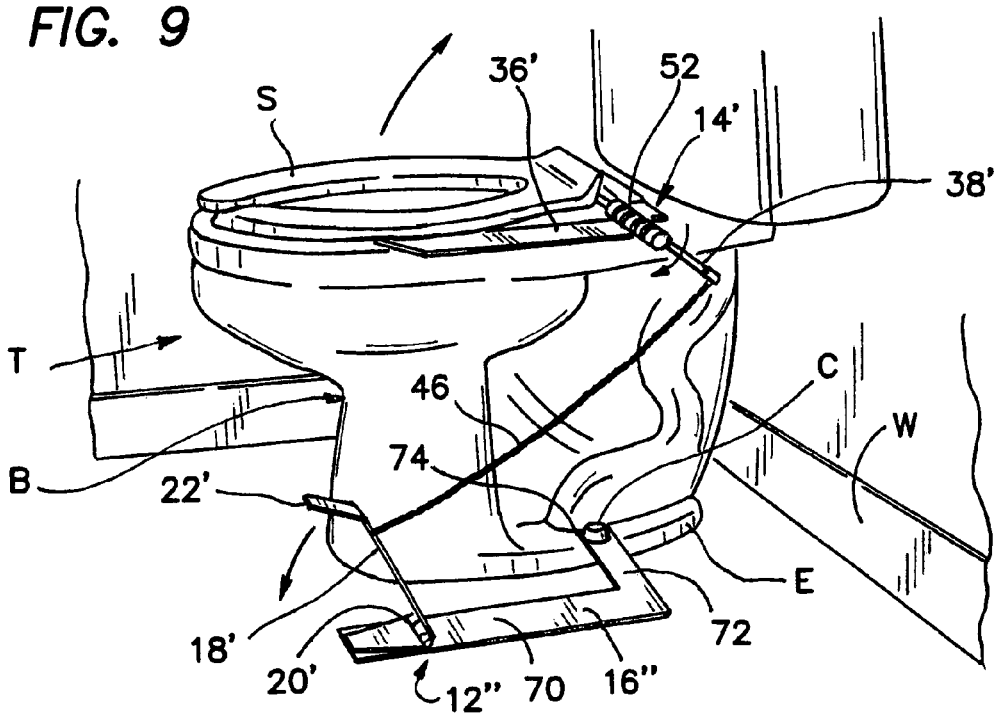
FIG. 9 is a perspective view of a second alternate embodiment of the foot actuated toilet seat lifter of this invention.

The pedal assembly is shown in two variants 12' and 12" in FIGS. 6 and 9 respectively. In FIG. 6 the pedal assembly 12' has a floor base 16' with a front end 16'*a* and a rear end 16'*b*. The floor base 16' is relatively long, and of sufficient length such that when the rear end 16'*b* is placed against the wall W normally found behind the toilet bowl B, the front end 16'*a* lies near the front end of bowl B and within comfortable reach of the foot of a person standing in front of the toilet fixture T. A pedal 18' has a rear end connected by hinge 20' to the base 16', and a free end 22'. Preferably the pedal 18' is bent as at 56 so that an end section 58 of the pedal lies generally horizontally and parallel to floor base 16' in a normal elevated position of the pedal seen in FIG. 6. The pedal 18' is supported in this normal elevated position by a non-rigid link which may be a length of chain 46 attached to an intermediate point 58 of pedal 16' between free end 22' and hinge 20'. The other end of chain 46 is attached to free end 42' of actuating lever 38'.

The free end 22' of the pedal 18' extends towards the front 16*a'* of the floor base 16' and toward the user standing before the toilet fixture T. This orientation of the pedal 18' offers some advantage in leverage, in that it may be somewhat easier for the user to shift his or her weight onto the pedal end portion 58 and thereby depress the pedal. Depression of the pedal operates, as explained in connection with FIGS. 1 through 5, to pull down on the chain link 46 and apply a torque force to the end 42' of actuating lever 38'. The torque turns the rotor sleeve 52 which translates into upward swing of the lift arm 36, the free end of which then pushes up under seat S lifting the seat away from the bowl B, as previously explained. The length of chain link 46 is chosen so that the seat S is lifted to an elevated condition lesser than vertical so that the seat retains a tendency to return to the lowered condition of FIG. 6 under its own weight when the user's foot is removed from pedal 18'. This may be ensured by providing a suitable stop element on shaft 28' to limit rotation of sleeve 50 about the shaft and thereby limit upward movement of the seat S.

The floor base 12' in FIG. 6 includes a spacer plate 60 and has an optional retaining arm 62 which is attached transversely to the length of spacer plate 60. The spacer plate 60 can be of adjustable length between its opposite ends, as by a suitable telescopic arrangement, to allow for positioning of the pedal 16' at a preferred distance away from the wall W behind the fixture T. The retaining arm 62 has an arm end 64 which engages the toilet bowl B and acts in part to hold the spacer plate 60 at a given distance from the toilet bowl B. The retaining arm 62 is generally flat, with possible small angle bends 64*a*, 64*b*, at each end of the arm 62 as may be desirable to accommodate the arm to the relative height difference between the spacer plate 60 and the point of engagement with the bowl B. The arm end 64 may simply abut against the side of the toilet bowl B or may be affixed to a bolt cap 66 typically provided on many toilet fixtures for covering the anchoring bolts of the fixture. A replacement bolt cap 66 may be permanently attached as by adhesive or other convenient means to the retaining arm 62, such that the cap 66 replaces an existing original bolt cap of the toilet fixture T, and acts as a retainer cap for the retaining arm 62 when fitted over the existing floor anchor bolt of the toilet fixture. The spacer plate 60 and retaining arm 62 cooperate to hold the pedal assembly 12' in position relative to the toilet bowl B against reaction forces of the chain link 46 pulling on the pedal 16' or against incidental pushing of the pedal assembly on the floor by persons using the toilet fixture.

In FIG. 9 and alternate floor base 16" is provided which has a base plate 70 for supporting the hinged pedal assembly 12" with a pedal 18' hinged to base plate 70 by hinge 20' and a side arm 72 with an arm end 74 which attaches to the toilet bowl B. The base plate 70 and side arm 72 may be a single integral generally flat sheet of sufficiently rigid material, such as plastic or resin. The arm end 74 has a bolt hole (not shown in the drawings) which passes the conventional anchor bolt through the base of the toilet fixture T. Preferably, the arm end 74 is held captive against the toilet bowl base by the nut normally threaded onto the upwardly extending end of the anchor bolt. The nut is normally tightened against the base of the toilet bowl to secure the fixture against the bathroom floor. The floor base 70 is installed by temporarily removing any nut cap C of the fixture T and unscrewing the existing nut from the anchor bolt. The arm end 74 is then fitted onto the end of the anchor bolt and the nut replaced and tightened on the bolt. The nut cap C is then replaced over the anchor bolt end the tightened nut to restore the fixture T to a finished appearance. The arm end 74 may also have a bearing surface adapted to abut against the base edge E of the toilet fixture while the arm end is engaged to the anchor or base mounting bolt of the fixture. The bearing surface prevents the floor base from turning about the anchor bolt mounting of the side arm 72 as a result of operating forces of the pedal assembly 12'.

A noteworthy feature of the foot actuated toilet seat lifters of this invention is that in each described embodiment the seat lifter can be sold in disassembled form as a kit of parts for assembly by an end user. Furthermore, in its disassembled form the kit consists of a number of substantially flat or small diameter components which can be packaged conveniently for commercial distribution, sale and storage.

In the case of the embodiment 10 of FIG. 2, rod 24 may be mounted in a friction fit in a hole in pedal 18 and removed for packaging purposes. The pedal 18 may be folded to a flat coplanar condition with floor base 16. The actuating assembly 14 may be similarly disassembled to a number of substantially flat components by pulling actuating rod 38 out of a mounting hole in sleeve 32, and separating sleeve 32 from shaft 28. Also, chain link 46 may be detached from rods 24 and 38. Assembly of these components is not difficult for the average end user, and when so disassembled the entire seat lift apparatus can fit in a compact, easily handled package.

In the case of the embodiments of FIGS. 6 through 9 the pedal 16' of pedal assembly 12' can be folded down to a generally flat condition against the floor plate 70. The actuating assembly 14' can also be disassembled by separating the actuating lever 38' and lifting arm 36' from sleeve 50, and optionally removing sleeve 50 from shaft 28'.

While preferred embodiments of the invention have been described and illustrated for purposes of clarity and example only, it should be understood that many changes, modifications and substitutions to the described embodiments will be apparent to those having only ordinary skill in the art without thereby departing from the scope of the invention, as defined in the following claims.

What is claimed is:

1. A foot actuated toilet seat lift for a toilet fixture having a bowl and a seat hinged to a pair of mounting plates secured to the bowl by mounting bolts passing through mounting holes in said bowl, said lift comprising:

a pedal assembly having a floor base positionable on a floor surface adjacent to the bowl, a pedal having a proximal end hinged to said floor base and a distal end movable between an elevated condition and a depressed condition, an extension rod extending from said distal end of the pedal away from said proximal end, an actuator assembly including a thin and elongated seat base plate having a pair of bolt holes located for passing the said pair of mounting bolts for securing said base plate between said bowl and said seat, a lifting arm supported for rotation to said seat base with a free end of said lifting arn positioned under said seat, an actuating lever fixed for rotation with said lifting arm, and a chain connecting said actuating lever to a free end of said extension rod for lifting the said seat with said free end of said lifting arm responsive to depression of said distal pedal end relative to said floor base.

2. The toilet seat lift of claim 1 wherein said linkage has an effective length selected such that said lift arm returns to a lowered position under the weight of the seat for lowering said seat upon release of said pedal from a depressed position to a normal position.

3. The toilet seat lift of claim 1 herein said seat base is generally planar for relatively unobtrusive mounting between the said seat and the said bowl.

4. The toilet seat lift of claim 1 wherein said actuating lever and said arm are both mounted to a common rotor element, said rotor element rotatably supported to said seat base.

5. The toilet seat lifter of claim 4 wherein said rotor element is rotatable on a shaft extending from said base.

6. The toilet seat lift of claim 4 wherein said lift arm and said actuating lever extend in generally opposite directions from said rotor element.

7. The toilet seat lift of claim 1 wherein said linkage is adjustable in length between said extension rod and said actuating lever.

8. The toilet seat lift of claim 1 wherein said linkage is a chain.

9. The toilet seat lift of claim 1 wherein said seat base is a thin and elongated plate having a pair of bolt holes located for passing the said pair of mounting bolts.

10. The toilet seat lift of claim 1 wherein said linkage is detachable from said rod and said actuating lever.

11. The toilet seat lift of claim 1 wherein said actuating lever and said lifting arm can be separated from said seat base.

12. The toilet seat lift of claim 1 wherein said seat base is a thin plate with a shaft extending therefrom and said lever and said lifting arm are rotatable on said shaft.

13. The toilet seat lift of claim 1 wherein said pedal is supported in a normal elevated condition relative to said floor base by said chain.

14. A toilet seat lift for a toilet fixture having a bowl and a seat hinged to a pair of mounting plates secured to the bowl by mounting bolts passing through mounting holes in said bowl, said lift comprising:

a floor base freely positionable on a floor surface adjacent to said bowl, a pedal hinged to said floor base, an extension rod extending from said pedal, an actuator assembly including a seat base, an actuating lever and a lifting arm both supported for rotation to said seat base, said seat base being adapted to receive said mounting bolts such that said assembly may be secured between said mounting plates and said bowl by sole means of said mounting bolts with a free end of said lifting arm positioned under said seat, and a linkage connecting said rod with said actuator assembly such that depression of said pedal on a floor surface adjacent to said bowl is transmitted by said linkage for depressing said actuating lever so as to raise said free end of said lifting arm thereby to lift said seat relative to said bowl, said linkage permitting movement of said floor base in two dimensions over a limited distance on the said floor surface;

wherein said pedal has a proximal end hinged to said floor base and a distal end movable between an elevated condition and a depressed condition, said extension rod extending from said distal end of the pedal away from said proximal end, said linkage being connected to a free end of said extension rod.

* * * * *